United States Patent [19]

Walker

[11] 4,123,621

[45] Oct. 31, 1978

[54] ACOUSTICAL SPEAKER DEVICE

[76] Inventor: Frank J. Walker, 3300 Lone Pine, West Bloomfield, Mich. 48033

[21] Appl. No.: 857,390

[22] Filed: Dec. 5, 1977

[51] Int. Cl.[2] ..... H04R 1/28

[52] U.S. Cl. ..... 179/1 E; 181/150; 181/151; 181/153

[58] Field of Search ..... 179/1 DD, 1 E, 146 E, 179/179; 181/148, 149, 150, 151, 153

[56] References Cited

U.S. PATENT DOCUMENTS

| | | | |
|---|---|---|---|
| 3,892,930 | 7/1975 | Wieder | 179/179 |
| 3,912,865 | 10/1975 | Seebinger | 179/1 E |

*Primary Examiner*—George G. Stellar
*Attorney, Agent, or Firm*—Basile and Weintraub

[57] ABSTRACT

An acoustical speaker device adapted to be recessed in, for example, the ceiling of a room, has a paraboliform loudspeaker housing with an open end and an aperture formed at its concave end generally coaxial with the open end. A collar coaxially surrounds and extends outwardly of the housing from the concave end. An electrical transformer is removably located in the collar, and the collar is closed by a removable cap. A loudspeaker device is disposed within the housing proximate the open end of the housing and is oriented to radiate sound waves outwardly of the housing through the open end.

14 Claims, 3 Drawing Figures

ACOUSTICAL SPEAKER DEVICE

BACKGROUND OF THE INVENTION

The present invention relates to acoustical speaker devices, and more particularly to an acoustical speaker device having a curved housing adapted to the recessed in a ceiling or wall.

Various types and forms of acoustic speaker devices are known. However, such speaker devices known to us are relatively physically large and, therefore, difficult to recess in a ceiling or wall. In addition, because of the size and shape of the heretofore known acoustical speaker devices, their presence in a ceiling or wall is visually obvious. Furthermore, many of the known speaker devices which are to be recessed in a ceiling or wall do not have housings which are adept at directing sound waves toward a desired location.

SUMMARY OF THE INVENTION

The present invention provides an acoustical speaker device which is truly self contained, thus, providing for simple installation, which is relatively small so that it can be recessed in a confined space, which when recessed in a ceiling or wall is visually unobtrusive, and which has a housing for effectively directing sound waves toward a desired location.

More particularly, the present invention provides an acoustical speaker device with a paraboliform housing open at one end and having an aperture at the concave end opposite to and coaxial with the open end. A cylindrical collar which coaxially surrounds the aperture is attached to the concave end of the housing and projects outwardly of the housing from its concave end. A cap is removably coaxially disposed over the collar thereby closing it. The collar and the cap each have two circumferentially opposed slots in its side walls, the slots in the cap being in registration with the slots in the collar. A resilient clip connects the cap to the collar. This clip generally has a U-shaped body with tongue formation in each leg of the U-shape. The U-shaped clip is positioned within the cap so that each tongue projects through different one of the slots in the collar. A transformer is disposed between the legs of the U-shaped resilient clip and is attached to the clip so that when the cap is coaxially disposed over the collar with the resilient clip in place connecting the cap and collar together, the transformer is located within the collar. A loudspeaker device is located within the housing proximate the open end of the housing and is oriented to radiate sound waves through the open end. A layer of sound imprevious media is disposed across the aperture in the housing to acoustically isolate the transformer from the speaker. In addition, a sheet of acoustic pervious material is disposed over the open end of the housing to protect the loudspeaker device from tampering and to conceal the loudspeaker device from sight.

BRIEF DESCRIPTION OF THE DRAWINGS

For a more complete understanding of the invention, reference may be had to the following specification and accompanying drawings in which like numerals refer to like parts throughout, and in which.

DETAILED DESCRIPTION OF THE PREFERRED EMBODIMENT

Figure 1:
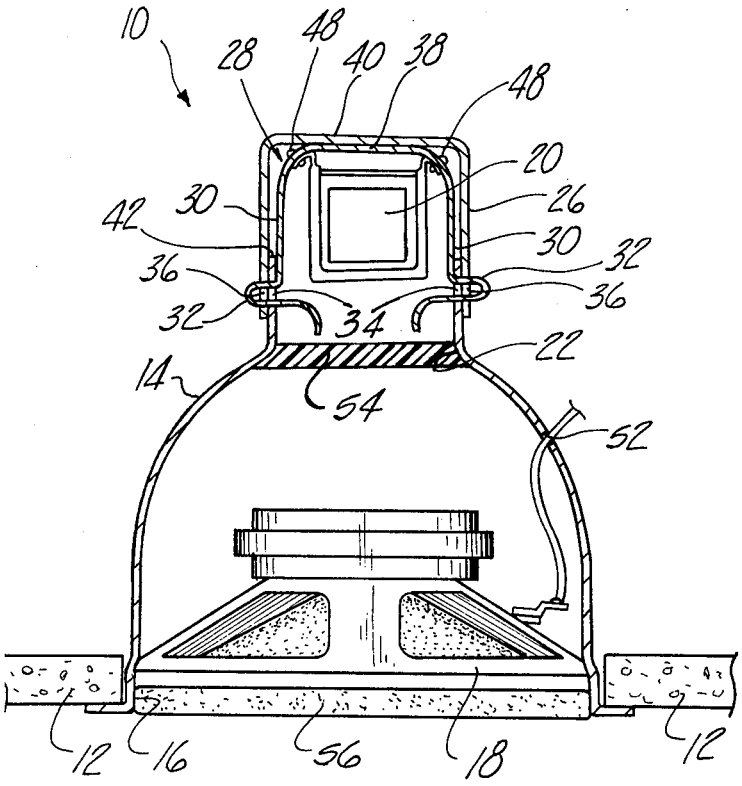
FIG. 1 is a cross-sectional view of the acoustic speaker device of the present invention recessed in a ceiling.

FIG. 1 shows in cross-section an acoustic speaker device, generally denoted by the numeral 10, recessed in a room ceiling 12. It should be understood, however, that the acoustic speaker device 10 can also be recessed in a wall.

With continued reference to FIG. 1, the acoustic speaker device 10 comprises a parabolic shaped housing 14 being open, as denoted by the numeral 16, opposite its concave end, a loudspeaker device 18 disposed in the housing 14 proximate the opening 16 oriented to radiate sound waves outwardly of the housing through the opening 16, and an electrical transformer 20 located in the housing 14 a distance away from the loudspeaker device 18. The parabolic shape of the housing 14 effectively serves to reflect and direct sound waves toward a desired location and at the same time provides a clean compact configuration suitable for being recessed in confined spaces.

The housing 14 comprises an aperture 22 through its concave end generally opposite to and coaxial with the opening 16 of the housing. A collar 24 coaxially surrounds the aperture 22 and extends outwardly of the housing 14 from the convex side of the concave end of the housing. The collar 24 can be a separate component attached to the housing 14 or the housing may be integrally formed with the collar 24 if manufacturing economics so dictate. A cap 26 is removably coaxially disposed over the collar 24 to close the collar and, thus, the aperture 22.

Figure 2:
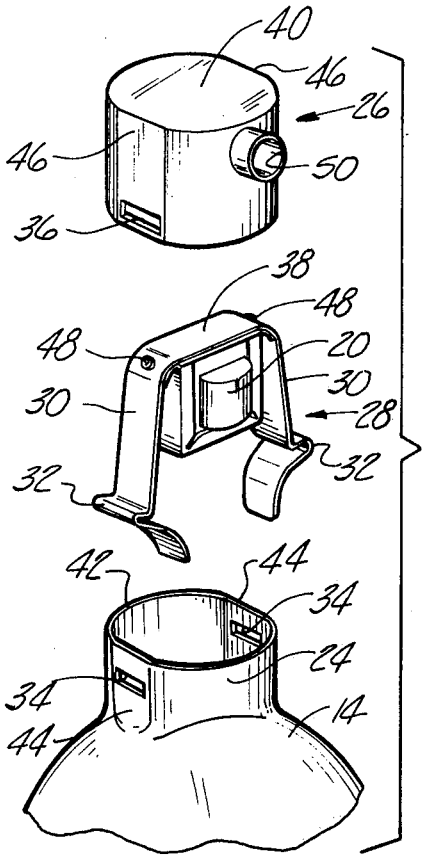
FIG. 2 is an exploded perspective view of a portion of the speaker device of the present invention; and, FIG. 3 is an enlarged cross-sectional view of a portion of the speaker device of the present invention.
Figure 3:
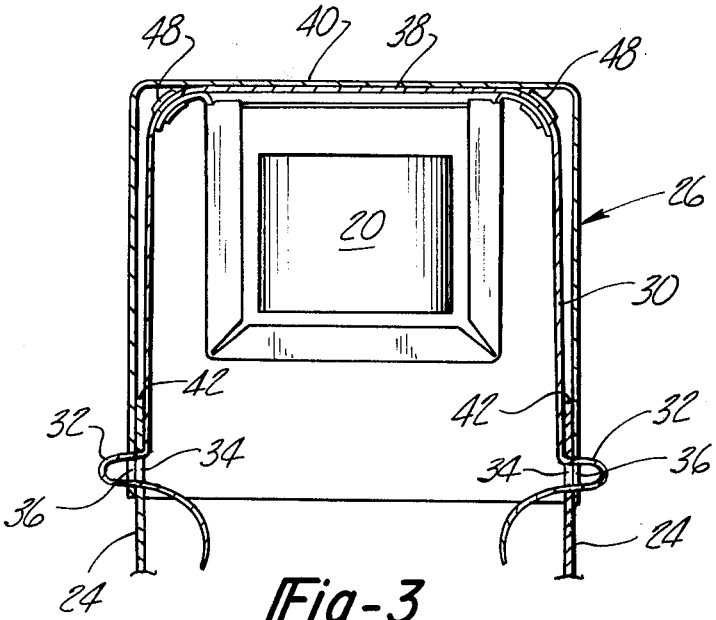

As can be best seen in FIGS. 2 and 3, the cap 26 is removably secured to the collar 24 to prevent the cap 26 from being inadvertently separated from the collar, but at the same time providing for its easy intentional removal from the collar 24 when it is desired to gain access to the interior of the collar. The means for removably securing the cap 26 to the collar 24 comprises a resilient clip 28 which coacts with the cap 26 and collar 24. The clip 28 has a generally U-shaped body with resilient legs 30. Each resilient leg 30 is formed with a tongue 32 projecting generally outwardly of the U-shaped body of the clip 28. The tongues 32 are illustrated as being formed by a portion of the legs 30 of the U-shaped clip 28 being folded over itself. The cap 26 and collar 24 are each formed with means for engaging each outwardly projecting tongue 32 of the U-shaped clip 28. The means formed in the collar 24 for engaging each tongue 32 of the U-shaped slip 28 comprises at least two slots 34 formed in the wall of the collar 24 circumferentially oppositely disposed from one another around the periphery of the collar. Likewise, the means formed in the cap 26 for engaging each tongue 32 of the U-shaped clip 28 comprises at least two slots 36 formed in the side wall of the cap 26 circumferentially oppositely disposed from one another around the periphery of the cap. The slots 34 in the collar 24 and slots 36 in the cap 26 are sized and located in their respective components so that when the cap 26 is coaxially disposed over the collar 24 each one of the slots 36 in the cap is in registration with a different one of the slots 34 in the collar. The resilient clip 28 is located within the cap 26 with the cross-member 38 of the U-shaped body of the clip 28 in juxtaposition to the closed end 40 of the cap 26 and the legs 30 of the clip 28 extending in an axial direction of the cap 26 in juxtaposition to the side wall of the cap. The length of each of the legs 30 from the cross-member 38 of the U-shaped body to the tongue 32 formed therein generally corresponds to the distance between the slots 34 and the edge 42 of the collar 24, and the distance between the slots 36 and closed end 40 of the cap 26. Thus, when the cap 26 is coaxially disposed over the collar 24 each tongue 32 of the U-shaped clip projects through a different one of the slots 34 in the collar 24 and through the respective slot 36 of the cap 26 in registration therewith.

In order to locate the cap 26 on the collar 24 so that the slots 34 and 36 are in proper mutual registration, the wall of the collar 24 is formed with two planar surfaces 44 circumferentially opposed from one another around the periphery of the collar, and the side wall of the cap 26 is likewise formed with two planar surfaces 46 circumferentially opposed from one another around the periphery of the cap 26. Each planar surface 46 of the cap 26 mates in juxtaposition with a different one of the planar surfaces 44 of the collar 24 when the cap is coaxially disposed over the collar 24. Preferably, each of the slots 34 in the collar 24 is formed in a different one of the planar surfaces 44 of the collar, and each of the slots 36 in the cap 26 is formed in a different one of the planar surfaces 46 of the cap 26.

The transformer 20 is located between the legs 30 of the U-shaped body of the resilient clip 28 and is attached to the resilient clip 28 by, for example, conventional screws or pop rivets 48. Thus, with the cap 26 secured to the collar 24, the transformer 20 is located inside the collar 24.

The cap 26 has an aperture 50 formed through its side wall for receiving an electrically conductive wire (not shown) connecting the transformer 20 to an external source of energy.

The housing 14 also has an aperture 52 formed through its wall for receiving therethrough an electrically conductive wire (not shown) connecting the loudspeaker device 18 to an external source of energy.

In order to dampen vibrations possibly generated by the transformer 20 a layer of vibration damping media 54 is coextensively disposed across the aperture 22 in the concave end of the housing 14 at the juncture of the housing 14 and collar 24. In practice it has been found that an open cell low density foam works well for this purpose.

When the acoustical speaker device 10 is recessed, the only part of the device which is visible is the opening 16 and the loudspeaker device 18. In order to prevent tampering with the loudspeaker device 18 and also to conceal the loudspeaker device 18 from sight, a sheet of acoustically pervious material 56 is disposed over the opening 16.

Because the acoustical speaker device is self contained, it can be installed quickly and easily, and because it is compact it can be installed in confined space.

The foregoing detailed description is given primarily for clarity of understanding and no unnecessary limitations should be understood therefrom for modifications will be obvious to those skilled in the art upon reading this disclosure and may be made without departing from the spirit of the invention or the scope of the appended claims.

What is claimed is:

1. An acoustic speaker device comprising:

a parabolic shaped housing adapted to be recessed in a ceiling or the like, the parabolic housing being open opposite the concave end thereof and having an aperture formed through the concave end;

a collar coaxially surrounding the aperture and projecting outwardly of the housing from the convex side of the concave end of the housing;

an electrical transformer disposed in the collar, means for removably mounting the transformer in the collar;

a cap coaxially disposed over the collar for closing the collar;

means for removably securing the cap to the collar; and, a loudspeaker device disposed within the housing proximate the opening of the housing and oriented to radiate sound waves outwardly of the housing through the opening.

2. The acoustic speaker device of claim 1, wherein the means for removably mounting the transformer in the collar and the means for removably connecting the cap to the collar are one and the same means.

3. The acoustic speaker device of claim 1, wherein the means for removably connecting the cap to the collar comprises a resilient clip coacting with the cap and collar to interconnect the cap and collar.

4. The acoustic speaker device of claim 3, wherein:

the resilient clip comprises a generally U-shaped body having resilient legs, and a tongue formed in each leg of the U-shaped body, each tongue projecting generally outwardly of the U-shaped body;

means formed in the cap for engaging each outwardly projecting tongue of the resilient clip; and, means formed in the collar for engaging each outwardly projecting tongue of the resilient clip.

5. The acoustic speaker device of claim 4, wherein the means formed in the collar for engaging each outwardly projecting tongue of the resilient clip comprises the collar being formed with at least two circumferentially opposed slots in its side wall, each slot receiving therethrough a different one of the outwardly projecting tongues of the resilient clip.

6. The acoustic speaker device of claim 5, wherein the means formed in the cap for engaging each outwardly projecting tongue of the resilient clip comprises the cap being formed with at least two circumferentially opposed slots in its side wall, each of the slots in the cap is disposed in registration with a different one of the slots in the collar when the cap coaxially receives the collar, and each slot receives therethrough a different one of the outwardly projecting tongues of the resilient clip.

7. The acoustic speaker device of claim 6, wherein the resilient clip is disposed inside the cap so that the tongues formed in the legs of the U-shaped clip project through the slots in the cap and the slots in the collar outwardly form inside of the cap and the coaxial disposed collar.

8. The acoustical device of claim 4, wherein:

the side wall of the collar is formed with at least two circumferentially opposed planar surfaces;

the means formed in the collar for engaging each outwardly projecting tongue of the resilient clip comprises at least two circumferentially opposed slots, one formed in each of the planar surfaces of the collar, each slot receiving therethrough a different one of the outwardly projecting tongues of the resilient clip;

the side wall of the cap is formed with at least two circumferentially opposed planar surfaces each of which mates in juxtaposition with a different one of the planar surfaces of the collar when the cap coaxially receives the collar; and, the means formed in the cap for engaging each outwardly projecting tongue of the resilient clip comprises at least two circumferentially opposed slots, one formed in each of the planar surfaces of the cap, each of the slots in the cap is disposed in registration with a different one of the slots in the collar when the cap coaxially receives the collar, and each slot receives therethrough a different one of the outwardly projecting tongues of the resilient clip.

9. The acoustic speaker device of claim 8, wherein each leg of the U-shaped body of the resilient clip has a portion folded over itself to form the tongue.

10. The acoustic device of claim 4, wherein the transformer is disposed between the legs of the U-shaped resilient clip and is attached to the resilient clip.

11. The acoustic speaker device of claim 1, further comprising means disposed across the aperture in the housing for damping vibrations produced by the transformer.

12. The acoustic speaker device of claim 1, further comprising a sheet of acoustic pervious material coextensively disposed over the opening of the housing to protect the loudspeaker device from tampering and to conceal the loudspeaker device from sight.

13. The acoustic device of claim 1, wherein the cap is formed with an aperture for receiving therethrough an electrically conductive wire connecting the transformer to a source of energy.

14. The acoustic speaker device of claim 1, wherein the housing is formed with an aperture through its wall for receiving therethrough an electrically conductive wire connecting the loudspeaker device to a source of energy.

* * * * *